United States Patent [19]

Thiele et al.

[11] 4,042,484

[45] Aug. 16, 1977

[54] METAL ANODE FOR ELECTRO-CHEMICAL PROCESSES

[76] Inventors: Gerhard Thiele, Uttenreuth; Dieter Zollner, Schwaig; Konrad Koziol, Rothenbach, all of Germany

[21] Appl. No.: 540,173

[22] Filed: Jan. 10, 1975

Related U.S. Application Data

[63] Continuation-in-part of Ser. No. 299,140, Oct. 19, 1972, abandoned, which is a continuation-in-part of Ser. No. 98,227, Dec. 15, 1970, abandoned.

[51] Int. Cl.[2] ..... C25B 11/08

[52] U.S. Cl. ..... 204/290 F; 204/290 R; 252/518; 423/593

[58] Field of Search ..... 204/290 R, 290 F; 252/518; 423/592–594

[56] References Cited

U.S. PATENT DOCUMENTS

| | | | |
|---|---|---|---|
| 2,950,996 | 8/1960 | Place et al. | 338/333 |
| 3,313,721 | 4/1967 | Teel | 204/196 |
| 3,498,931 | 3/1970 | Rogers et al. | 423/594 X |
| 3,514,414 | 5/1970 | Shannon | 252/518 |
| 3,616,445 | 10/1971 | Bianchi et al. | 204/290 F |
| 3,649,485 | 3/1972 | Chisholm | 204/95 |
| 3,681,261 | 8/1972 | Mason et al. | 252/514 |
| 3,687,724 | 8/1972 | Keith et al. | 427/126 |
| 3,711,382 | 1/1973 | Anthony | 204/1 R |

FOREIGN PATENT DOCUMENTS

| | | | |
|---|---|---|---|
| 1,506,040 | 11/1967 | France | 204/290 F |
| 1,816,820 | 8/1969 | Germany | 204/290 R |
| 1,164,477 | 9/1969 | United Kingdom | 204/290 F |

*Primary Examiner*—F.C. Edmundson

*Attorney, Agent, or Firm*—Gifford, Chandler, Sheridan & Sprinkle

[57] ABSTRACT

A protective cover layer is provided for the basis metal of an electrolytic anode, particularly for anodes used in the production of chlorine and caustic soda. The cover layer comprises a non-stoichiometric compound having the empirical formula:

$$M_nPt_3O_4$$

where M is lithium, sodium, potassium, silver, or copper and *n* is a number in the range of about 0.4 to 0.6.

16 Claims, No Drawings

METAL ANODE FOR ELECTRO-CHEMICAL PROCESSES

RELATIONSHIPS TO OTHER APPLICATIONS

This application is a continuation-in-part of our copending application Ser. No. 299,140 filed Oct. 19, 1972, now abandoned which was a continuation-in-part of our prior application Ser. No. 98,227 filed Dec. 15, 1970 now abandoned.

BACKGROUND OF THE INVENTION

The present invention relates to a cover layer for a metal anode for electrochemical processes, particularly those processes carried out in a highly corrosive environment such as the electrochemical production of chlorine and caustic soda.

Platinum, platinum metals and alloys thereof have been known for a long time as electrode materials. For example, the first horizontal mercury cells were equipped with anodes of platinum and platinum-iridium for the electrolytic production of chlorine and caustic soda. The rather high investment costs for equipping the anodes with platinum wire and the considerable corrosion rates of the valuable precious metal —the specific platinum loss even at relatively low current densities reached from 0.3 to 0.6 grams of platinum per ton of produced chlorine — soon made it necessary to adopt the more economical graphite anodes.

The idea of coating a non-precious base metal; such as copper, iron, etc.; with platinum in order to obtain an anode material at a reasonable price is also very old. In chlorine-alkali electrolysis these platinum-plated metal anodes rather quickly succumbed to the corrosive influences of the cell media.

Similarly, metals such as titanium, tantalum, zirconium, niobium, and alloys thereof have been used as anode basis metals. These have become known as "valve" metals because of their tendency to passivate rapidly by the formation of a tight oxide cover layer, which layer effects a rectifier effect on current passing therethrough. The valve metal anodes have been covered with a cover layer of platinum or platinum alloys but these also have been found unsuitable for use in the chlorine alkali industry. The expensive plating of precious metal does not withstand for any length of time the various intensive stresses; whether of mechanical, electrical, chemical or electrochemical nature; which prevail in modern giant cells. The effectiveness of the platinum metal layer which, for reasons of cost is kept rather thin, soon decreases. This, on one hand, leads to continuing increases in the voltage and, on the other hand, makes a frequent exchange of the anode necessary. In the widely used horizontal mercury cells the danger of short-circuiting is particularly great and with the tendency of platinum to form an amalgam the danger exists that the entire metal anode equipment will suddenly become inactive.

It is therefore the principal object of this invention to provide an improved cover layer for an electrolytic anode basis metal where said cover layer is economical; is thermally stable; is not soluble in standard solvents; is stable in electrolytic baths, particularly those containing salt brines and mercury; has a relatively low anodic overvoltage for chlorine evolution; has a relatively high anodic overvoltage for oxygen evolution; and is resistant to various intensive stresses of a mechanical, chemical, and electrochemical nature.

SUMMARY OF THE INVENTION

We have now found that the foregoing and related objects are achieved with a cover layer which comprises a non-stoichiometric compound having the empirical formula:

$$M_nPt_3O_4$$

wherein M is a monovalent element selected from the group consisting of lithium, sodium, potassium, silver, and copper and $n$ is a number in the range of about 0.4 to about 0.6, but preferably about 0.5.

Further, we have found that such material when used alone, or together with binders and other electrical conductors, can be applied as a superior coating for a basis metal used as an electrolytic anode. The basis metal, or core metal, is preferably a valve metal or, more particularly, a valve metal with a conducting layer of platinum or platinum metal alloy. The basis metal can, however, be any metal suitable for use as an electrolytic anode such as base metals (copper, aluminum, iron, etc.) coated with platinum and/or coated or clad with a valve metal. Such suitable anode metals are now well known in the art and the cover layer of the invention can be used with any of them.

There is generally no problem with the adherence of the coating to the usual basis metals used as anodes and generally no problem with the stability or electrical conductivity of the coatings of the invention. However, depending on the basis metal used and the purpose to which the anode is to be put, the cover layer may, in addition to the compounds of the type $M_nPt_3O_4$ contain up to about 85% binders, stabilizers and substances which improve the electric conductivity. As binders and stabilizers there may be employed various inorganic and/or organic additions which aid the sintering and the adherence of the cover layer of the invention.

Such additions may, for instance, be resins, low melting glasses, mixtures of metal oxides, binary oxide compounds as for example spinels; synthetic resins such as polyester and bisphenol resins etc.; and synthetic materials such as polytetrafluorethylene as far as they are stable in the media of the electrolysis. When a very thin cover layer is employed, for instance less than 2 microns, or a cover layer with a relatively low content of $M_nPt_3O_4$, the effectiveness of such layer may be increased by substances which are stable in the media of the electrolysis, particularly in the media of electrolysing brine, and which improve the electric conductivity of the layer. Such substances are, for instance, doped oxides of the metals and/or spinels; borides and hydrides of the transition metals of the fourth to sixth group of the periodic system; carbides; and nitrides of titanium, tantalum, zirconium, niobium or mixtures thereof.

EXAMPLE I

A sheet of titanium with the dimensions of $100 \times 100 \times 1$ millimeters was etched for 40 minutes in the vapor of boiling 20% sulfuric acid (boiling hydrochloric acid may also be used) and subsequently was rinsed with water and dried. To the thus pretreated metal sheet was then applied a methanolic suspension of a finely ground mixture (less than 1 micron) of 200 milligrams of $Li_nPt_3O_4$ (where $n$ is about 0.5) and 50 milligrams of a low melting glass. The mixture was burned in at 600° C for a period of 30 minutes in an argon atmosphere. The same application was repeated a second time under the same conditions. The low melting glass, which in this instance functions as a binder, was produced from 7.8 grams $K_2CO_3$, 15.0 grams $CaCl_2$, 36.0 grams $Pb_3O_4$, 6.7 grams $Al_2O_3$, 43.8 grams $SiO_2$, 9.0 grams $B_2O_3$ and 10.0 grams CuO.

Anodes prepared according to this example operated for 3500 hours in a NaCl laboratory cell without ascertainable wear of the coating and without increase in the voltage of the cell.

EXAMPLE 2

A titanium sheet pretreated in the manner described in Example I had the dimensions 100×100×1 millimeters and was coated with an aqueous suspension of approximately equal weights of aluminum hydroxide and finely ground $Li_nPt_3O_4$ (where $n$ is about 0.5). Thereupon, the titanium metal sheet was treated in an argon atmosphere at a temperature of 500° C. for a period of 120 minutes. Subsequently, a second cover layer of the same suspension was applied in the same manner. For purposes of consolidating the two layers, the treated metal sheet was heated in an argon atmosphere for 60 minutes at a temperature of 800° C.

Anodes produced according to this example operated for a period of 4 weeks in a NaCl laboratory cell without ascertainable loss in weight.

EXAMPLE 3

A titanium sheet pretreated as in Example 1 and having a size of 100×100×1 mm. was coated with a hexanolic suspension consisting of 25 mg. $TiB_2$, 12.5 mg. $Li_nPt_3O_4$ (where $n$ is about 0.5) and 12.5 mg. of the low melting glass described in Example I. The coating was burned in at a temperature of 600° C for 30 minutes in an argon atmosphere. The coating step was repeated nine times so that a total of 250 mg. of titanium boride, 125 mg. $Li_nPt_3O_4$ and 125 mg. of low melting glass was applied. Anodes produced in this manner proved stable in a NaCl laboratory cell and after 10 days showed no visible or measurable changes.

EXAMPLE 4

261 mg. $Zn(NO_3)_2.4\ H_2O$, 240 mg. $CoCl_2.6H_2O$, 202 mg. $Fe(NO_3)_3.9H_2O$, and 326 mg. $Li_nPt_3O_4$ (where $n$ is about 0.5) were mixed with 3 ml. $H_2O$, 3 ml. $CH_3OH$, 1 ml. of concentrated HCl and 10 drops of isopropanol. The resulting mixture was ground to a particle size of less than 1 micron. A titanium sheet (100×100×1 mm.) prepared as in Example 1 was coated ten times with the resulting suspension and, each coating was burned in at a temperature of 400° C. in air for a period of 120 minutes. For consolidating the cover layer and for purposes of forming a ZnCoFe spinel the coated sheet was heated to 480° C for a period of 120 minutes. The resulting coating weighed 70 mg. Anodes produced in this manner operated 3000 hours of operation in NaCl electrolytes without change.

EXAMPLE 5

A titanium sheet, pretreated as in Example 1 and having the dimensions 135×10×1 ml., was coated three times with an ethanolic suspension consisting of finely ground (less than 1 micron) $Na_nPt_3O_4$ (where $n$ is about 0.5). After each coating the coating was burned in at a temperature of 600° C. for a period of 20 minutes in an argon atmosphere. The increase in weight of the test anode corresponded to 20 grams of the $Na_nPt_3O_4$ per square meter.

Anodes prepared in accordance with this example were used in a NaCl laboratory cell at a current density of 6 kA/m² and a cell voltage of 3.8 volts. Results with the $Na_nPt_3O_4$ coating were comparable to those with the $Li_nPt_3O_4$ coatings of Examples 1–4, inclusive.

EXAMPLE 6

100 grams of platinum sponge were dissolved in aqua regia. The nitrogen oxide gases were eliminated by evaporation until an almost completely dry product was obtained. The latter was dissolved in concentrated hydrochloric acid. Subsequently 1.1 liters of 20% hydrochloric acid were added and the resulting solution was evaporated down to about one liter. The thus obtained $H_2PtCl_6$ solution was carefully added while stirring continuously to 1.3 liters of 30% KOH and, after cooling, the resulting $K_2PtCl_6$ deposit was filtered off. The deposit was carefully washed with distilled water and was then dried and powdered.

Potassium nitrate was heated to 400° C in an $Al_2O_3$ crucible. The potassium hexachloroplatinate was slowly added to the salt melt through a vibration channel in order to reduce the intensity of the reaction. The added $K_2PtCl_6$ should not exceed 4 grams Pt per 100 grams of potassium nitrate. For completion of the reaction, the 400° C hot melt was stirred continuously in the furnace for 12 hours. After cooling and adding distilled water to the crucible a suspension of water-insoluble platinum oxide and a nearly saturated $KNO_3/KNO_2$ solution was formed. The latter were separated through a suction filter. The $PtO_2$ that collected in the suction filter was washed several times with hot distilled water and was subsequently dried at 120° C. The resultant $PtO_2$ was finely powdered. A comparable platinum oxide product was also made starting with a finely ground, commercially available, ammonium hexachloroplatinate instead of the potassium hexachloroplatinate prepared as indicated above. A salt mixture consisting of 60 mol% of lithium chloride and 40 mol% potassium chloride was melted and heated to 580° C in an aluminum oxide crucible. The dried and powdered $PtO_2$ was added through a vibration channel to the melt. The saturation limit of the melt of about 10 grams Pt per 100 grams salt mixture should not be exceeded. After 6 hours at 480° C, the melt was heated another 12 hours at 600° C and was then cooled. The blue-black powder, which remained after the salt mixture was dissolved indistilled water, was filtered off, was washed with distilled water and hydrochloric acid, and was subsequently boiled in aqua regia. After renewed filtering and washing with distilled water; the compound was dried, finely ground, analysed, and its crystalline structure was checked by x-ray.

The foregoing process was carried out three times and the formulas of the resulting crystalline products corresponded to $Li_{0.51}Pt_3O_4$, $Li_{0.55}Pt_3O_4$ and $Li_{0.57}Pt_3O_4$. Powder reproductions of $Li_{0.57}Pt_3O_4$ according to the Guinier and Debye-Scherrer process may be cubically indicated with $a$ = 5,619 A. For two formula units per elementary cell, the x-ray density was calculated at 12.23 grams/cm³ which was in good agreement with the pyknometrically found density of 12.27 grams/cm³. All three products were excellent electrical conductors.

Anodes of a pure titanium core with a cover layer in which one of the test compounds was contained up to 70% by weight have been tested as to their behavior under similar operating conditions. The results of these tests are shown in Table 1 and Table 2.

EXAMPLE 7

Two samples of the blue-black platinum oxide products made in the manner described in Example 6 were dissolved in a NaCl—$NaNO_3$ salt melt at 600° to 620° C and the final products had compositions corresponding to the formulas $Na_{0.44}Pt_3O_4$ and $Na_{0.52}Pt_3O_4$.

Anodes comparable to those of Example 6 were made and tested. Results are shown in Tables 1 and 2.

EXAMPLE 8

The temperature, time and composition of the reaction melt of Examples 6 and 7 were changed to form products with compositions corresponding to the formulas $Li_{0.22}Pt_3O_4$, $Li_{0.83}Pt_3O_4$, $Na_{0.29}Pt_3O_4$ and $Na_{0.78}Pt_3O_4$.

Anodes comparable to those of Examples 6 and 7 were made and tested. Results are shown in Tbles 1 and 2.

TABLe 1

Anodic Overvoltage

| | |
|---|---|
| Electrolyte | 310 grams NaCl/liter |
| pH | 2 - 2,5 |
| Temperature | 80° C |
| $V_1$ | voltage difference between current densities of 1000 and 10 A/m² |
| $V_2$ | voltage difference between current densities of 5000 and 10 A/m² |

| Anode No. | Example | Coating | $V_1$ | $V_2$ |
|---|---|---|---|---|
| 1 | 6 | $Li_{0.51}Pt_3O_4$ | 0.03 | 0.07 |
| 2 | 6 | $Li_{0.55}Pt_3O_4$ | 0.04 | 0.06 |
| 3 | 6 | $Li_{0.57}Pt_3O_4$ | 0.03 | 0.06 |
| 4 | 8 | $Li_{0.22}Pt_3O_4$ | 0.10 | 0.18 |
| 5 | 8 | $Li_{0.83}Pt_3O_4$ | 0.07 | 0.16 |
| 6 | 7 | $Na_{0.44}Pt_3O_4$ | 0.04 | 0.07 |
| 7 | 7 | $Na_{0.52}Pt_3O_4$ | 0.04 | 0.07 |
| 8 | 8 | $Na_{0.29}Pt_3O_4$ | 0.09 | 0.15 |
| 9 | 8 | $Na_{0.78}Pt_3O_4$ | 0.08 | 0.16 |

TABLe 2

Specific platinum loss

| | |
|---|---|
| Electrolyte | 310 grams NaCl/Liter |
| pH | 2.5 - 5 |
| Temperature | 78 - 82° C |
| Current Density | 10 kA/m² |

| Anode No. | Example | Coating | Platinum loss mg/ton chlorine over 9000 hours |
|---|---|---|---|
| 1 | 6 | $Li_{0.51}Pt_3O_4$ | 60 |
| 2 | 6 | $Li_{0.55}Pt_3O_4$ | 50 |
| 3 | 6 | $Li_{0.57}Pt_3O_4$ | 70 |
| 4 | 8 | $Li_{0.22}Pt_3O_4$ | 90 |
| 5 | 8 | $Li_{0.83}Pt_3O_4$ | 80 |
| 6 | 7 | $Na_{0.44}Pt_3O_4$ | 60 |
| 7 | 7 | $Na_{0.52}Pt_3O_4$ | 70 |
| 8 | 8 | $Na_{0.29}Pt_3O_4$ | 80 |
| 9 | 8 | $Na_{0.78}Pt_3O_4$ | 100 |

In accordance with the general procedure outlined in Example 6 a number of materials corresponding to the formula $M_nPt_3O_4$ were made and tested. The blue-black platinum oxide product was mixed, in turn, with a number of relatively low melting point salts including salts of lithium, sodium, potassium, monovalent silver, monovalent copper, and salts of other metals, to yield respectively; $Li_nPt_3O_4$, $Na_nPt_3O_4$, $K_nPt_3O_4$, $Ag_nPt_3O_4$, $Cu_nPt_3O_4$ and $M_nP_3O_4$, s the case may be. An additional salt was frequently added to lower the melting point in order to carry out the reactions at temperatures in the range of about 400°-800° C. with convenience. These materials were tested as electrode cover materials and it was in this manner that the monovalent elements; lithium, sodium, potassium, silver and copper; were selected as suitable.

Similarly, and as indicated by Tables 1 and 2 materials with formulas wherein the subscript *n* varied from about 0.2 to about 0.8 were prepared and tested as cover materials for a number of different basis metals. In this manner it was established that when *n* is about 0.5 the material is most suitable and as *n* drops below about 0.4 or increases above about 0.6 the value of the invention diminishes.

The lithium, sodium, potassium, silver, and copper compounds of the invention have many advantages when used as electrode cover layers. It has been observed that:

1. They are effective over a long period of time.
2. They do not amalgamate with or react with mercury.
3. They are relatively short-circuit resistant because of their high thermal resistance and their resistance against amalgamation.
4. Ions from the cover layer do not enter the electrolytic media and thus introduce no technical problems during electrolysis.
5. The anodes have a low separation over-voltage for chlorine and a high separation over-voltage for chlorine and a high separation over-voltage for oxygen, permitting chlorine-alkali electrolysis at relatively high current densities.
6. They lead to a highly economical operation because of their heat, chemical, and mechanical stability and because of their current carrying effectiveness.

Investigations concerning the electrical resistance of the substances of the type $M_nPt_3O_4$ show an agreement with the theoretical thinking based upon lattic structure; that is, that the specific electrical resistance increases with the magnitude of the M atom the electrical conductivity of the lithium compound therefore being the largest. Even though all these compounds must be designated as very good electrical conductors, the preferred compound for the high current loaded anodes illustrated in the examples is $Li_{0.5}Pt_3O_4$. The corresponding sodium compound is preferred at this time in large technical installations in the chlorine-alkali-electrolysis because, in spite of the nominally less conducting capability, it is believed there can result a somewhat more economical operation because of an assumed higher stability of the sodium compounds with a multi-year operation as compared with the lithium compounds. However, a conclusive statement about the eventual differing stabilities of the individual compounds in anodic installation, in view of the already known extremely high stability of these compounds, must await the conclusion of tests of longer duration.

We claim:

1. In an anode structure for use in electrochemical processes comprising a basis metal and a cover layer thereon the improvement wherein said cover layer comprises a compound having the empirical formula $$M_nPt_3O_4$$

where M is selected from the group of monovalent elements consisting of lithium, sodium, potassium, silver, and copper and wherein *n* is a number in the range of about 0.4 to about 0.6.

2. The anode structure as defined in claim 1 wherein M is lithium.

3. The anode structure as defined in claim 1 wherein M is sodium.

4. The anode structure as defined in claim 1 wherein M is potassium.

5. The anode structure as defined in claim 1 wherein M is silver.

6. The anode structure as defined in claim 1 wherein M is copper.

7. The anode structure as defined in claim 1 where *n* is about 0.5.

8. The anode structure as defined in claim 1 wherein said basis metal is a valve metal.

9. The anode structure as defined in claim 1 wherein said basis metal is titanium.

10. The anode structure as defined in claim 1 wherein said basis metal is layered with a metal selected from the group consisting of platinum and platinum alloys.

11. The anode structure as defined in claim 1 wherein said cover layer additionally comprises a binder stable in contact with the media of an electrolysing brine.

12. The anode structure as defined in claim 1 wherein said cover layer additionally comprises a material which increases the electrical conductivity of the layer and which is stable in contact with the media of an electrolysing brine.

13. The anode structure as defined in claim 11 wherein said binder comprises up to about 85% by weight of said cover layer.

14. The anode structure as defined in claim 12 wherein said material comprises up to about 85% by weight of said cover layer.

15. The anode structure as defined in claim 1 wherein said cover layer additionally comprises up to about 85% by weight of a mixture of a binder and a material which improves the electrical conductivity of the layer wherein said binder and said material are stable in contact with the media of an electrolysing brine.

16. The anode structure as defined in claim 1 wherein *n* is about 0.5 and said basis metal is a valve metal.

* * * * *

UNITED STATES PATENT AND TRADEMARK OFFICE

CERTIFICATE OF CORRECTION

PATENT NO. : 4,042,484

DATED : August 16, 1977

INVENTOR(S) : Gerhard Thiele, Dieter Zollner, & Konrad Koziol

It is certified that error appears in the above-identified patent and that said Letters Patent are hereby corrected as shown below:

Col. 4, line 50, delete "indistilled", insert, --in distilled--;

Col. 5, line 20, delete "Tbles", insert --Tables--;

line 23, delete "TABLe", insert --TABLE--;

line 39, delete "TABLe", insert --TABLE--;

line 63, delete "$M_nP_3O_4$, s", insert --$M_nPt_3O_4$, as--.

Col. 6, line 26, delete the whole line;

line 50, delete "pounds", insert --pound--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*